US009091083B1

(12) United States Patent
Goudreau

(10) Patent No.: US 9,091,083 B1
(45) Date of Patent: Jul. 28, 2015

(54) ADJUSTABLE STAIRCASE

(71) Applicant: OTTAWA HOSPITAL RESEARCH INSTITUTE, Ottawa (CA)

(72) Inventor: Louis Goudreau, Gatineau (CA)

(73) Assignee: Ottawa Hospital Research Institute, Ottawa, Ontario (CA)

( * ) Notice: Subject to any disclaimer, the term of this patent is extended or adjusted under 35 U.S.C. 154(b) by 0 days.

(21) Appl. No.: 14/202,478

(22) Filed: Mar. 10, 2014

(30) Foreign Application Priority Data

Mar. 5, 2014 (CA) ..... 2844895

(51) Int. Cl.

| | |
|---|---|
| ***E04F 11/09*** | (2006.01) |
| ***E04F 11/104*** | (2006.01) |
| ***E04F 11/06*** | (2006.01) |
| ***E04F 11/04*** | (2006.01) |
| ***E04F 11/025*** | (2006.01) |

(52) U.S. Cl.
CPC ..... *E04F 11/1041* (2013.01); *E04F 11/0255* (2013.01); *E04F 11/04* (2013.01); *E04F 11/066* (2013.01)

(58) Field of Classification Search
CPC ..... E04F 11/1041; E04F 11/04
USPC ..... 52/182, 183; 182/1
See application file for complete search history.

(56) References Cited

U.S. PATENT DOCUMENTS

| | | | | |
|---|---|---|---|---|
| 2,888,182 | A * | 5/1959 | Nixon | 182/1 |
| 3,083,784 | A * | 4/1963 | Urian | 182/88 |
| 3,491,498 | A * | 1/1970 | Hughes, Jr. | 52/187 |
| 3,593,821 | A * | 7/1971 | Lister | 182/115 |
| 3,757,894 | A * | 9/1973 | Chamberlin | 182/106 |
| 3,995,832 | A * | 12/1976 | Wiese | 256/59 |
| 4,100,995 | A * | 7/1978 | Pradon | 182/1 |
| 4,102,086 | A * | 7/1978 | Korman | 52/9 |
| 5,454,196 | A * | 10/1995 | Gaines et al. | 52/183 |
| 5,557,893 | A * | 9/1996 | Bowls | 52/187 |
| 5,802,773 | A * | 9/1998 | Pingel | 52/10 |
| 5,901,813 | A | 5/1999 | Orgal | |
| 5,907,935 | A * | 6/1999 | Elena | 52/182 |
| 6,256,946 | B1 * | 7/2001 | Kennedy et al. | 52/183 |
| 6,474,024 | B1 * | 11/2002 | Macintyre | 52/9 |
| 6,814,522 | B1 * | 11/2004 | Daniel, III | 403/162 |

(Continued)

FOREIGN PATENT DOCUMENTS

| | | | | |
|---|---|---|---|---|
| DE | 10053985 A1 * | 5/2002 | | E04F 11/18 |
| DE | 69818040 T2 | 7/2004 | | |

(Continued)

OTHER PUBLICATIONS

"Especial Needs, Patented 3-in-1 Training Staircase," http://www.especialneeds.com/rehab-equipment-stairs-patented-3-in-1-training-staircase.html, retrieved online Jul. 10, 2014, 2 pages.

(Continued)

*Primary Examiner* — Adriana Figueroa
(74) *Attorney, Agent, or Firm* — Gail C. Silver; Borden Ladner Gervais LLP

(57) ABSTRACT

Disclosed herein is an adjustable staircase wherein each tread of the staircase is suspended from a tread adjustment mechanism. The tread adjustment mechanism allows the coordinated movement of all the treads to a desired rise height, and allows the positioning of the first tread directly on a supporting surface when it is in a fully lowered position.

17 Claims, 7 Drawing Sheets

(56) References Cited

U.S. PATENT DOCUMENTS

| | | | |
|---|---|---|---|
| 7,927,257 | B2 | 4/2011 | Patel |
| 8,075,008 | B1 | 12/2011 | Hanser et al. |
| 8,091,294 | B2 | 1/2012 | Whalen |
| 2002/0088669 | A1 | 7/2002 | Truckner et al. |

FOREIGN PATENT DOCUMENTS

| | | | |
|---|---|---|---|
| DE | 202010007868 | U1 | 11/2010 |
| EP | 0832339 | B1 | 5/2001 |
| EP | 0984894 | B1 | 9/2003 |
| EP | 2144836 | B1 | 3/2012 |
| WO | 2012057595 | A1 | 5/2012 |
| WO | 2012118386 | A1 | 9/2012 |

OTHER PUBLICATIONS

"Dynamic Star Trainer—Speeds up rehabilitation. Increases motivation.", http://www.dpemed.com/products/dynamic-stair-trainer-dst.html, retrieved online Feb. 11, 2005, 3 pages.

* cited by examiner

A

B

ADJUSTABLE STAIRCASE

FIELD

The present disclosure relates to staircases having an adjustable rise height that may be used for the rehabilitation of subjects.

BACKGROUND

The ability to safely navigate stairs is a key determinant of whether or not a person may return home after undergoing physical rehabilitation. Conventional methods used in physiotherapy to train people to ascend and descend staircases are not ideal. Typically, makeshift wooden blocks are used to simulate lower step training and wooden staircases with fixed stair heights (4" and 6") are used to simulate higher steps. The limited range of riser heights of these staircases do not meet the needs of most patients, as most patients require training on steps that are lower or higher than the available heights. Furthermore, the weight capacity and design most often cannot accommodate a patient and his/her therapist, or even a heavier patient by him/herself.

DE 20 2010 007 868 discloses a staircase to be used for the rehabilitation of patients in which the height of the steps is adjustable. The rise of each step can be adjusted individually by manual operation of a lateral adjustment mechanism. However, manual adjustment is not convenient. Furthermore, the first step is in a fixed position and is raised from the supporting surface as the frame of the staircase is positioned below the steps. Thus, a ramp may be required to access the first step. This is undesirable as the mechanics of walking up a ramp are different from the mechanics of climbing a step and physiotherapists do not want to train a patient in two different mechanistic processes. Furthermore, adding a ramp to access the steps, extends the footprint of the staircase.

Motorized staircases with variable height risers exist. For example, DE 69818040T2 discloses an adjustable staircase for use in the rehabilitation of patients. In this staircase the mechanism for raising the steps is positioned below each step. The lifting mechanism impedes the lowering of the first step so that it cannot come into contact with a supporting surface. A staircase with an adjustable rise is commercially available and is described as the Dynamic Stair Trainer (DST). The DST has a fixed bottom step that is offset from the ground by a height of 3 inches. Thus, these motorized staircases also require a ramp or a further set of fixed steps in order to access the first step. As described above, this is not desirable.

It is an object of the present disclosure to obviate or mitigate at least one disadvantage of previous rehabilitation staircases.

SUMMARY

Disclosed herein is an adjustable staircase having a plurality of treads suspended from a tread adjustment mechanism, allowing the coordinated movement of all the treads to a desired common riser height, and the positioning of the first tread directly on a supporting surface when it is in a fully lowered position.

The adjustable staircase disclosed herein includes at least two treads, each tread having a pair of lateral ends and the treads forming a first and subsequent steps of the staircase. The staircase also comprises a frame for supporting the staircase on the supporting surface, and a tread adjustment mechanism coupled to the frame and the treads. The tread adjustment mechanism allows the simultaneous movement of all treads between a fully lowered position and a raised position. Each tread is individually suspended at at least one of the lateral ends from the tread adjustment mechanism, allowing the tread of the first step to engage the supporting surface when the first tread is in the fully lowered position.

The tread adjustment mechanism comprises a tread adjustment bar and for each tread a tread hanger that is coupled to a lateral end of the tread, such that each tread is independently suspended from the tread adjustment bar. The frame of the adjustable staircase may include a newel post adjacent the first step, an end post adjacent a last of the subsequent steps and a support bar connecting the newel post to the end post. A number of upright posts, equivalent to the number of treads, are connected to the support bar in a spaced apart arrangement between the newel post and the end post, each upright post being slidably coupled to a tread hanger. The tread adjustment bar has a fixed end pivotally coupled to the newel post and a movable end coupled to a lifting mechanism. Movement of the lifting mechanism between a lowered and a raised position results in the movement of the adjustment bar from a lowered to a raised position. The tread hangers and the treads, being coupled to the tread adjustment bar, also move from a lowered to a raised position.

In an embodiment, the adjustable staircase comprises a pair of tread adjustment mechanisms, each tread being supported from one of the adjustment mechanisms at each lateral end such that the tread riser height of all the treads can be adjusted simultaneously. The adjustable staircase includes a first step and at least one subsequent step and comprises at least two treads, each tread having a first and a second lateral end, the treads forming the first and subsequent steps of the staircase. A frame supports the staircase on a supporting surface, and comprises a first newel post adjacent the first lateral end of the first step, a second newel post adjacent the second lateral end of the first step, a first end post adjacent the first lateral end of the last of the subsequent steps, and a second end post adjacent the second lateral end of the last of the subsequent steps. A first support bar connects the first newel post to the first end post, and a second support bar connects the second newel post to the second end post. A plurality of upright posts are connected to the first support bar in a spaced apart arrangement between the first newel post and the first end post and a plurality of upright posts are connected to the second support bar in a spaced apart arrangement between the second newel post and the second end post. A first tread adjustment mechanism is coupled to the frame and to the first lateral end of each step and a second tread adjustment mechanism is coupled to the frame and to the second lateral end of each step, the first and second tread adjustment mechanisms for simultaneously moving the treads between a fully lowered position and a raised position, wherein each tread is individually suspended from both the first and second tread adjustment mechanisms and wherein the tread of the first step engages the supporting surface when the first tread is in the fully lowered position.

In a further embodiment, each tread is cantilevered from the tread adjustment mechanism at a lateral end.

Other aspects and features of the present disclosure will become apparent to those ordinarily skilled in the art upon review of the following description of specific embodiments in conjunction with the accompanying figures.

BRIEF DESCRIPTION OF THE DRAWINGS

Embodiments of the present disclosure will now be described, by way of example only, with reference to the attached Figures.

DETAILED DESCRIPTION

The principles and operation of the adjustable staircase disclosed herein may be better understood with reference to the drawings and the accompanying description. Generally, the present disclosure provides an adjustable staircase in which the treads of the staircase are suspended from a tread adjustment mechanism. The tread adjustment mechanism allows the coordinated movement of the treads proportionally in a substantially vertical direction, so that the rise between each tread is substantially equivalent. Thus, the overall run of the staircase is constant, reducing the steepness of the steps when they are in a raised position. Advantageously, the treads or steps are moved simultaneously in a coordinated manner, making it easy for a user to change the height of the steps or treads.

By "suspended", it is meant that the tread adjustment mechanism is not located below the tread. Suspension of the treads allows the bottom tread to directly engage a supporting surface, such as a floor, when the step is in a lowered position. Thus, a ramp, or other access means is not required to access the first step. This is advantageous as a physiotherapist can focus on training a single movement pattern (i.e. climbing stairs) and is not required to also train the movement pattern of walking up a ramp. In addition, by not requiring a ramp or additional steps to access the first step, the staircase has a reduced footprint.

As used herein a "step" is composed of a tread and a riser. The "tread" is the portion of the step that is stepped on by a user. The term "riser" is used herein to describe the vertical portion between each tread, and may be missing from the step for an "open" stair effect. In this case, the step would comprise only a tread. The tread "depth" is measured from the outer edge of the tread to the vertical riser edge (the edge of a tread where a riser would connect). The "width" of a tread is measured from one lateral side to the other lateral side of the tread. The "rise height" or "rise" of each step (or tread) is measured from the top of one tread to the top of the next tread. A person using the stairs would move this distance vertically for each step he/she takes. A staircase is formed from at least two consecutive steps or treads.

Figure 1:
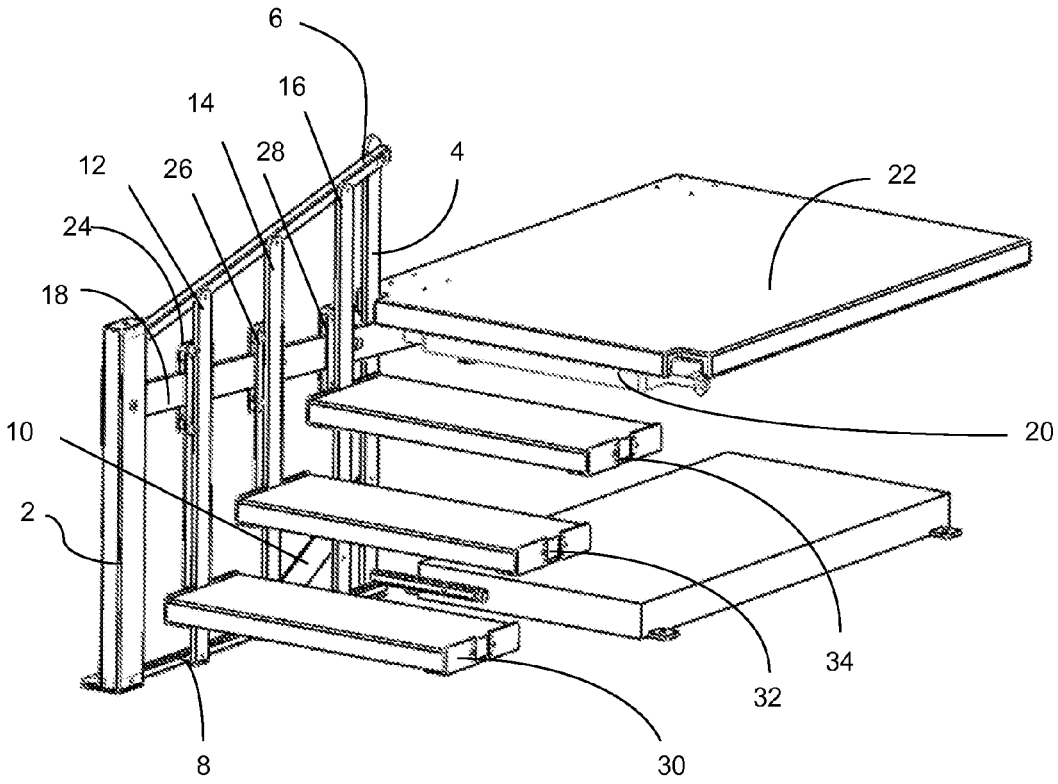
FIG. 1 is a perspective view of the adjustable staircase disclosed herein.

FIG. 1 shows an embodiment of an adjustable staircase as disclosed herein. Newel post 2 is connected to end post 4 by upper and lower support bars (6, 8) forming a frame for supporting the staircase. Bracing member 10 connects the lower support bar 8 to the end post 4 to add rigidity to the frame. In FIG. 1, only one half of the frame is shown, the other being a mirror image of the illustrated half and including a second newel post, connected to a second end post by a second pair of upper and lower support bars. Lateral support bars (not shown) may connect the first and second lower support bars, to provide further support for the frame. A plurality of upright posts 12, 14, 16 are connected to the upper and lower support bars (6, 8) in between the newel post 2 and the end post 4. The distance between the center of the newel post 2 and the center of the first upright 12 is equivalent to the depth of the tread. Each subsequent upright post 14, 16 is also separated by the same distance. For example, if the treads have a depth of 11 inches, the distance between the center of the newel post 2 and the center of the first upright 12 is 11 inches, as is the distance between the upright posts 12 and 14, and between upright posts 14 and 16. The treads may have different depths, however, the distance between newel post 2 and upright post 12, and the distance between upright posts 12, 14 and 16 will need to be adjusted, resulting in a different frame size.

An adjustment bar 18 is pivotally coupled to newel post 2 and coupled to a lifting bed frame 20, which supports a landing platform 22. Suspended from the adjustment bar 18, is a plurality of tread hangers 24, 26, 28, each tread hanger being connected to at least one lateral end of a tread 30, 32, 34 and in slidable engagement with an upright post 12, 14, 16. A lifting mechanism (not shown) is coupled to the lifting bed frame 20 and is used to raise and lower the landing platform 22 which moves the adjustment bar 18 about its pivot point. Any appropriate lifting mechanism may be used. For example, the lifting mechanism may be for example, a commercial scissor lift with an appropriate sized bed, such as 2'×4', a system of actuators, or an embedded forklift. The treads and the landing platform may be made of any suitable material. The material may be maintenance free and may be coated with an anti slip material. An example of a suitable material is Plexiglas.

Movement of the lifting mechanism (not shown) from a fully lowered position to a raised position results in a corresponding movement of the tread adjustment bar 18 from a lowered position to a raised position. Consequently the treads 30, 32, 34 are moved simultaneously from a fully lowered position to a raised position as they are connected to tread hangers 24, 26, 28 which are in turn coupled to the tread adjustment bar 18. The treads can be moved to a lowered position in which the bottom tread is in contact with a supporting surface, such as a floor. This engagement is possible because the step adjustment mechanism is overhead, i.e. it is not positioned below the tread. Thus, the minimum step rise (or height) of the first tread is limited only by the thickness of the tread. The maximum tread rise is limited only by what would be required or manageable by a patient or user. It is believed that a rise height of 10 inches is the maximum height that would be required in a rehabilitation staircase, but it is possible that a higher step or tread rise might be required if the staircase was used to train an athlete or to train for a specific movement pattern requiring a higher step riser height. The rise height between each tread of the adjustable staircase may be adjusted anywhere between the minimum and the maximum riser height. For example, the rise height may be adjusted to be 3 cm, 5 cm, 10 cm, or 1, 1.5, 1.5, 2, 2.5, 3.0, 3.5, 4.0, 4.5, 5.0, 5.5, 6.0, 6.125, 6.5, 7.0, 7.5, 8.0, 8.5, 9.0, 9.5 or 10 inches.

Figure 2:
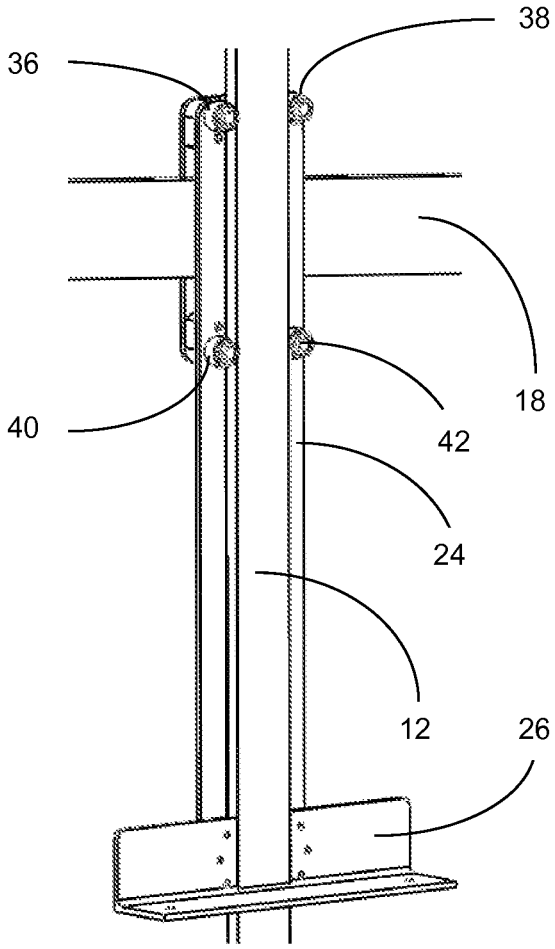
FIG. 2 is a side view of a tread hanger of the staircase shown in FIG. 1.
Figure 3:
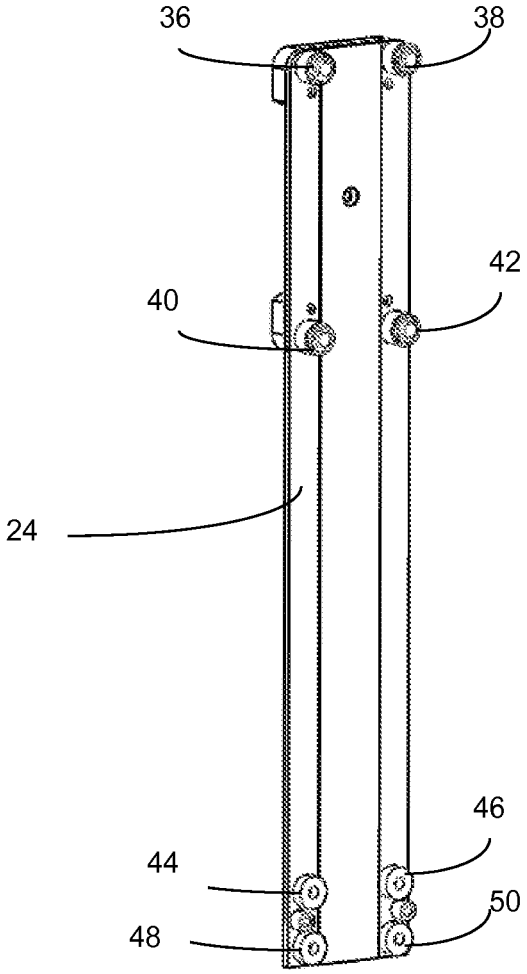
FIG. 3 is a side view of an upright post of the staircase shown in FIG. 1.
Figure 4:
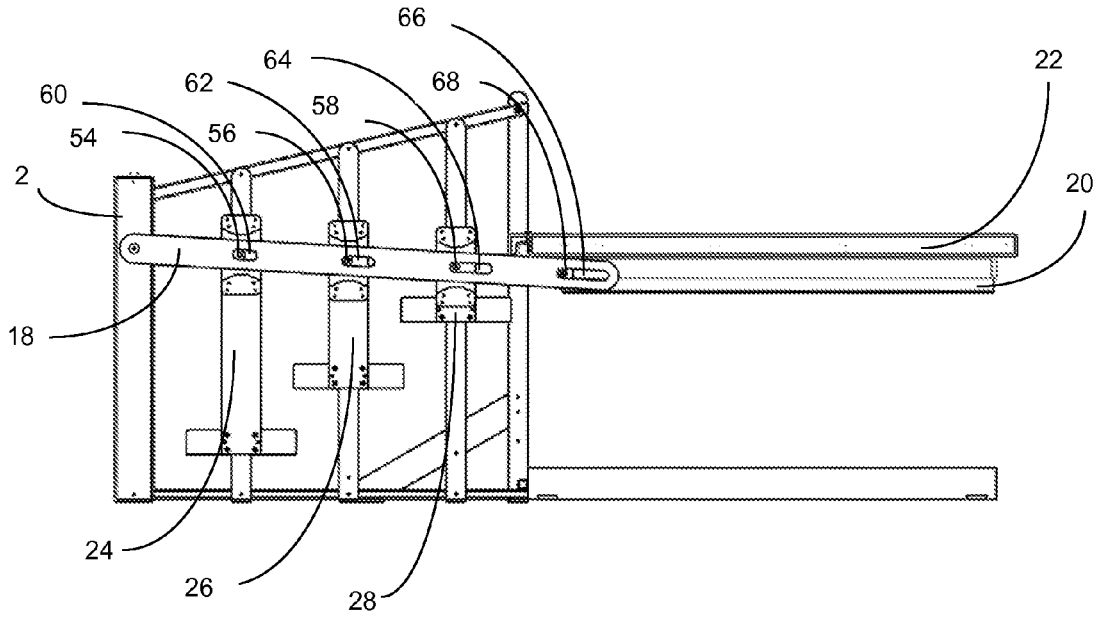
FIG. 4 is a side view of the tread adjustment mechanism and frame of the staircase shown in FIG. 1.

Together, the adjustment bar and the tread hangers form the tread adjustment mechanism which can be seen in more detail in FIGS. 2 to 4. In FIG. 2, an individual tread hanger 24 is shown. However, a separate tread hanger is coupled to at least one lateral end of each tread (not shown). Each tread hanger 24, slidably runs along the outside of a corresponding upright post 12 and is suspended from the adjustment bar 18. Fixed at the bottom end of the tread hanger 24, is an angle plate 26 with a guide opening in the middle to provide clearance for the upright post 12. The inner face of the angle plate 26 is flush with the surface of the upright post 12. The tread (not shown) is mounted on top of angle plate 26 and screwed, or otherwise fastened, in place. Although the tread is shown to be mounted on top of the angle plate, other configurations are contemplated. For instance, the angle plate may be inserted within the tread or may be connected to the lateral side of the tread. A first pair of upper rollers 36 and 38 and a second pair of upper rollers 40 and 42 are positioned on the tread hanger 24. The rollers 36, 38, 40 and 42 engage with the lateral edges of the upright post 12 as the tread hanger moves between lowered and raised positions and guides the movement of the tread hanger in a substantially vertical direction. A bottom or lower pair of rollers (not shown) is connected to the tread hanger and positioned behind the angle plate 26. The lower rollers also help to guide the movement of the tread hanger in a substantially vertical direction. The portion of the tread hanger facing the upright post 12 may be coated with a strip of high density polyurethane in order to prevent metal to metal contact and to provide a good gliding surface. Although polyurethane is exemplified, any coating or material that provides a good gliding surface may be used.

The positioning of two pairs of lower rollers 44 and 46, and 48 and 50 on the tread hanger 24 can be seen in FIG. 3. Lower rollers 44, 46, 48 and 50 cooperate with upper rollers 36, 38, 40 and 42 allowing only substantially vertical movement of the tread hanger 24. While rollers are exemplified, any guide mechanism that provides a vertical channel is contemplated. For example, the use of runners, idlers, a U-channel, or slotted holes with mating pins could achieve the same result. The rollers, idlers or the like may be made of any suitable material. For example, they may be made of neoprene or polyurethane or having a metal core, which allows the rollers or idlers to rotate freely.

FIG. 4 is a side view of the adjustable staircase showing the coupling of tread hangers 24, 26, 28 to adjustment bar 18. On the outer face of each tread hanger 24, 26, 28 is a shaft with a bushing 52, 54, 56 that engages a corresponding slot 60, 62, 64 on adjustment bar 18. Slot 66 couples adjustment bar 18 to bushing 68 on lifting bed frame 20. The engagement of the slots in the adjustment bar with the bushings on the tread hangers and lifting bed frame aids in the movement of the tread hanger in response to the movement of the adjustment bar about its anchor point as the adjustment bar is lowered and raised. Other means of coupling the tread hangers to the adjustment bar which provide vertical movement of the tread hangers are contemplated. For instance, the tread hangers may be coupled to the top of the adjustment bar and made to run along the top of the adjustment bar as the adjustment bar is moved between a raised and lowered position. The height of the pivoting point of adjustment bar 18 on newel post 2 is determined such that a normal step rise of 7.5 inches (the rise height of most steps) is achieved when adjustment bar 18 is positioned horizontally. Having the pivoting point at midrange reduces the side force on the tread hangers and minimizes the angle when adjustment bar 18 is sloped upward for a tread rise greater than 7.5 inches, or downward to achieve a tread rise less than 7.5 inches. The steeper the angle of the adjustment bar, the greater the lateral force, which requires a longer adjustment bar. Since each upright post is equally spaced by a distance equivalent to the tread depth (for example, 11 inches), the horizontal anchoring distance of adjustment bar 18 to the lifting bed frame 20 is again equivalent to the tread depth (for example, 11 inches) measured center to center from the last upright post. In this embodiment, adjustment bar 18 was designed to couple with the lifting bed frame 20 at a vertical distance of 4 inches under the landing platform 22. By doing so, landing platform 22 can be wider than the treads and the adjustment bar may be hidden underneath the landing platform. Cover plates (not shown) may be connected to tread hangers 24, 26, 28, to the newel post 2 or to lifting bed frame 20 to cover the bushings and slots or the pivot point of the adjustment bar. The cover plates may serve as a safety feature, or to protect the mechanism from damage. As can be seen clearly in FIG. 4, each tread hanger 24, 26, 28 is of a different length.

Figure 5:
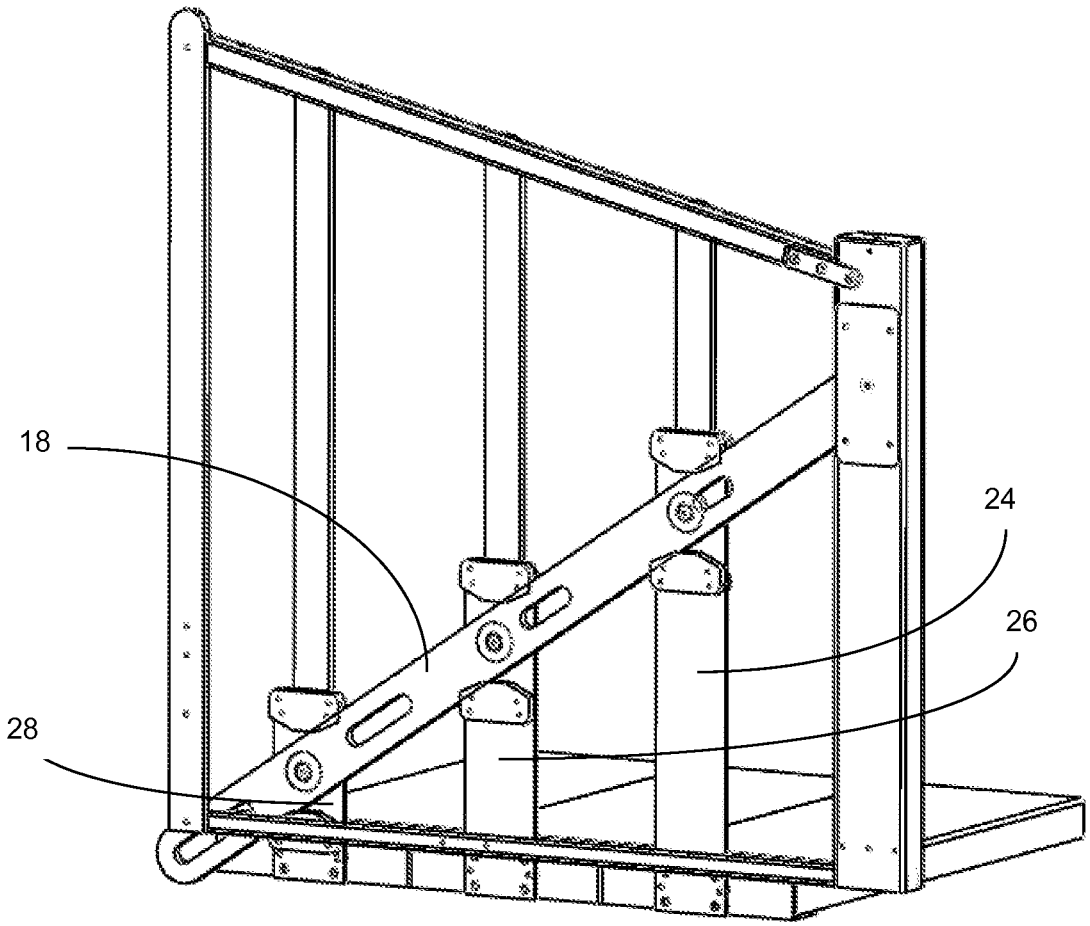
FIG. 5 is a side view of an adjustable staircase disclosed herein, showing how the tread hanger height is calculated.

FIG. 5 shows how the height of each tread hanger may be calculated. In this Figure the treads are in a lowered position in which all the treads are positioned such that the top surface of each tread is aligned with the supporting surface. In other words, the top of each tread is flush with the floor as if it was embedded inside the floor. This would only be possible if there was a hole in the floor as deep as the thickness of the tread and the thickness of the angle plate (not shown). In this position, it is easy to measure the height of each tread hanger 24, 26, 28 as the bottom face of the angle plate (not shown) that is connected to the tread becomes the baseline. From that baseline, the vertical distance is measured to the midpoint of the adjustment bar 18. This gives the exact position for the centre point of the pull pin and bushing assembly. The length of the hanger takes into consideration the dimension of the top bushing and the roller assembly (not shown). In this embodiment, each tread hanger has a set of four rollers at the top (around the bushing assembly) and another set of four idlers at the bottom (behind the angle bar holding a tread). For the smallest hanger, the bottom set of idlers at the bushing assembly and the top set of idlers at the angle plate coincide. The length of the hangers will vary with the configuration of the supporting bar. For example, in this embodiment, the supporting bar was designed to be in a horizontal position when the step rise is set at 7.5 inches and the pivoting point on the landing platform is set at 4 inches under the platform surface.

Figure 6:
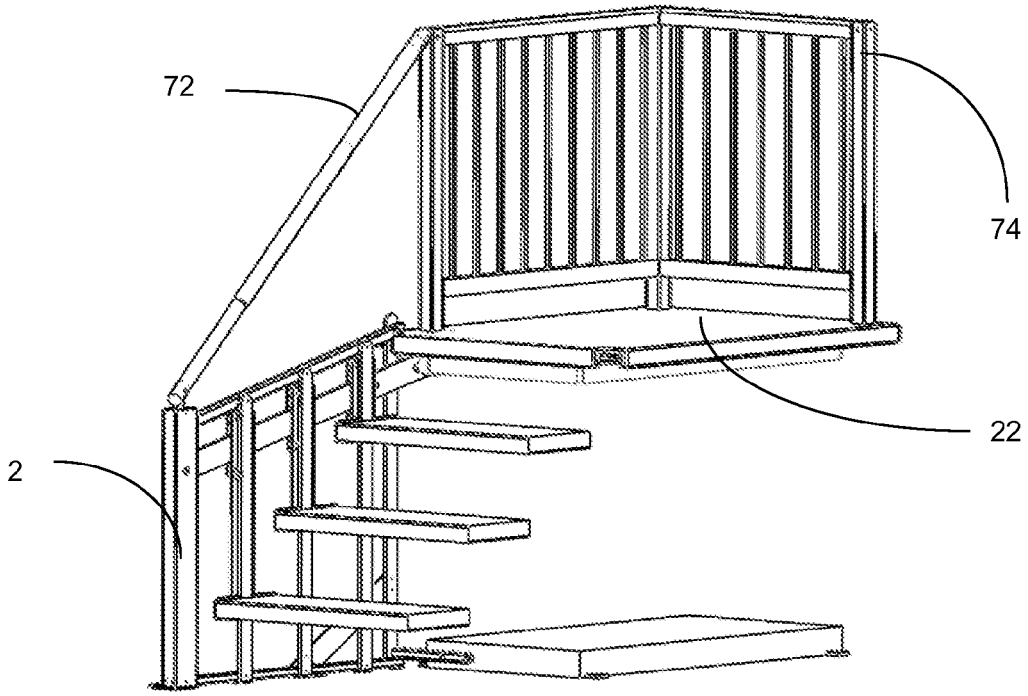
FIG. 6 is a perspective view of the adjustable staircase of FIG. 1 in a raised and a fully lowered position.
Figure 6:
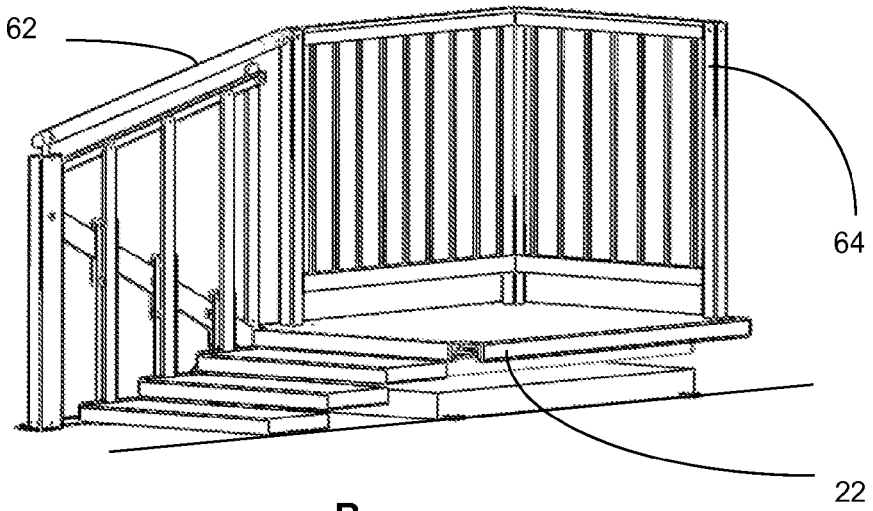

FIG. 6 shows the adjustable staircase in a raised position (A) and in a second, fully lowered position (B). Handrail 72 is coupled to the frame at newel post 2. Although not shown, a mirror image of the handrail and frame may be present at the right hand side. The handrails comprise two sections that are telescopic which allows the overall length of the handrails to be maintained as the staircase is moved between the positions A and B. The telescopic feature of the handrails allows the handrail to be maintained within the footprint of the staircase when it is in a lowered position. The height and width of the handrails may be adjustable, allowing an operator or user to customize the handrails to a user's specific needs. Handrail 72 is connected to guardrail 74, which is positioned around the outer edges of landing platform 22. Guardrail 74 may also be adjustable in height and may be modified depending on the needs of the user. An actuator (not shown) may be connected to the lifting mechanism allowing an operator to raise or lower the stairs to a desired height remotely and without effort.

Figure 7:
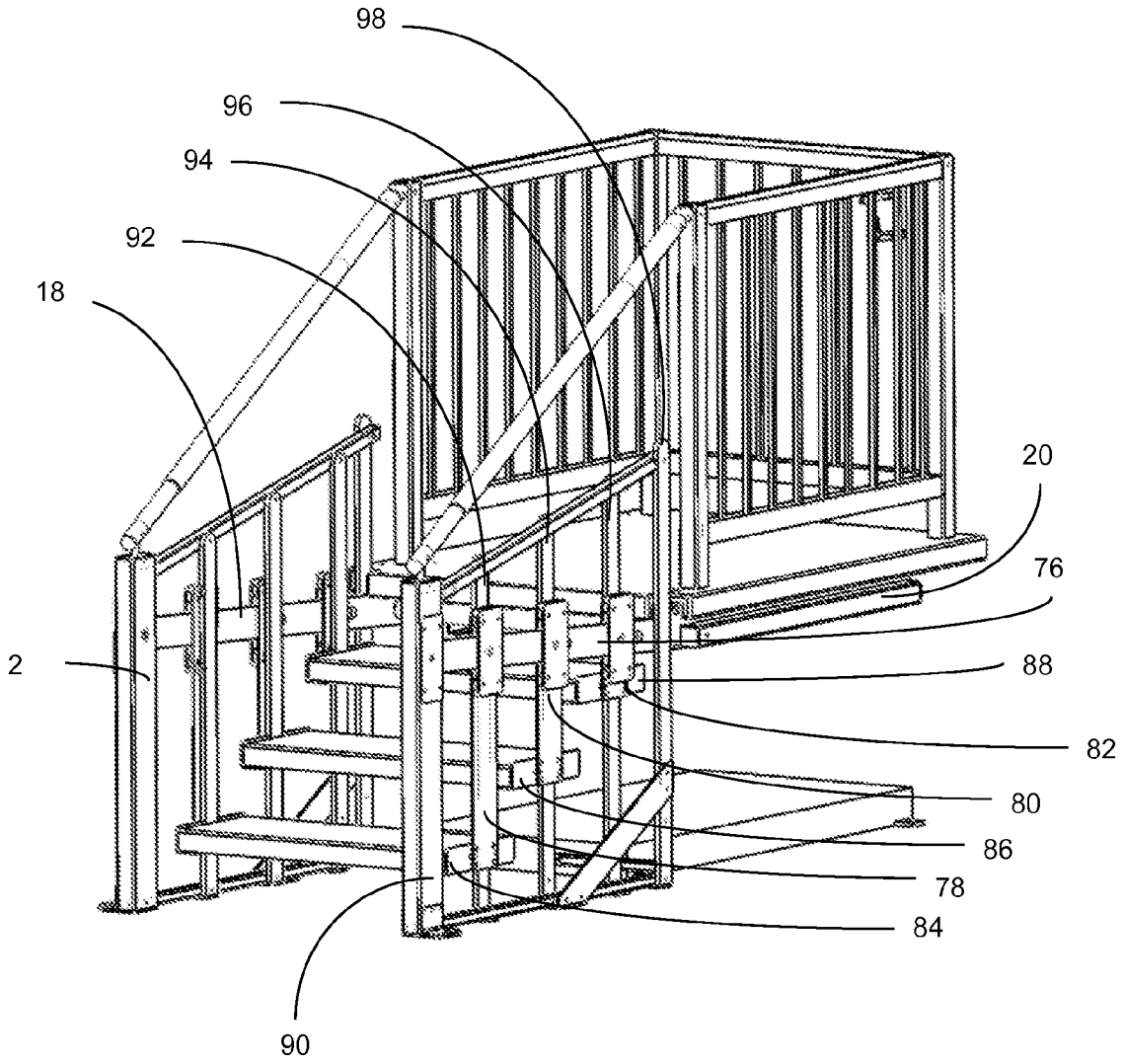
FIG. 7 is a perspective view of an embodiment of an adjustable staircase comprising two step adjustment mechanisms.

FIG. 7, shows the adjustable staircase with a second tread adjustment mechanism which includes a second adjustment bar 76 and a second series of tread hangers 78, 80 and 82 connected to the second lateral end of each tread 84, 86, 88. The second tread adjustment mechanism is a mirror image of the tread adjustment mechanism shown in FIG. 1 and may incorporate all the features described in FIGS. 1 to 6. The second tread adjustment mechanism works in a coordinated manner with the first adjustment mechanism to raise and lower the treads to a desired rise height. As can be seen in the Figure, each lateral end of each step is connected to a tread hanger. The second adjustment bar 76 is pivotally coupled to a second newel post 90 and coupled to the lifting bed frame 20. A series of upright posts 92, 94, 96 are spaced between the second newel post 90 and the second end post 98 and engage with tread hangers 78, 80 and 82 to allow the substantially vertical movement of the treads in response to movement of the lifting mechanism. The adjustment bars are positioned at equivalent positions on newel posts 2 and 90 allowing the coordinated movement of the adjustment bars, the tread hangers and the treads from a first position to a second position. Thus, adjustment bar 18 and second adjustment bar 76 cooperate to simultaneously move all the treads to a desired tread rise height.

In a further embodiment, only one newel post, end post and series of upright posts between the newel post and the end post are provided. In this embodiment, each tread is cantilevered at one lateral end from a tread hanger. The tread hangers are coupled to an adjustment bar as previously described. The number of treads corresponds to the number of tread hangers and the number of upright posts. The tread hangers are coupled to an adjustment bar as previously described.

The above-described embodiments are intended to be examples only. Alterations, modifications and variations can be effected to the particular embodiments by those of skill in the art without departing from the scope, which is defined solely by the claims appended hereto.

What is claimed is:

1. An adjustable staircase including a first step and at least one subsequent step, the adjustable staircase comprising:

a frame for supporting the staircase on a supporting surface;

a first and at least one subsequent tread, each tread having a pair of lateral ends and the treads forming the first and subsequent steps of the staircase; and a tread adjustment mechanism coupled to the frame and the treads, the tread adjustment mechanism comprising:

an adjustment bar coupled to the frame for simultaneously moving the treads between a fully lowered position and one or more raised positions, wherein each raised position has a rise between each tread that is substantially equivalent; and a tread hanger for each tread, each tread hanger being suspended from the adjustment bar, and each tread hanger having a different length, each tread being coupled at one of the lateral ends to the respective tread hanger, and the tread of the first step engaging the supporting surface when the first tread is in the fully lowered position.

2. The adjustable staircase according to claim 1, wherein each tread is cantilevered from the tread hanger at the one of the lateral ends.

3. The adjustable staircase according to claim 1, comprising a pair of tread adjustment mechanisms, each tread being suspended from one of the adjustment mechanisms at each lateral end.

4. The adjustable staircase according to claim 1, further comprising:

a newel post adjacent the first step;

an end post adjacent a last of the subsequent steps;

a support bar connecting the newel post to the end post; and a plurality of upright posts connected to the support bar in a spaced apart arrangement between the newel post and the end post, wherein the adjustment bar has a fixed end pivotally coupled to the newel post and a movable end; and a lifting mechanism is coupled to the movable end of the adjustment bar, for moving the adjustment bar between a lowered and a raised position, wherein the movement of the adjustment bar from the lowered position to the raised position moves the treads from the fully lowered to the raised position.

5. The adjustable staircase according to claim 4, further comprising a guide mechanism connected to each upright post for guiding the tread hanger in a substantially vertical direction as the treads move from the fully lowered position to the one or more raised positions.

6. The adjustable staircase according to claim 1, further comprising a hand rail connected to the frame.

7. The adjustable staircase according to claim 6, further comprising a guardrail coupled to the last of the subsequent steps and wherein the hand rail is connected to the newel post and the guardrail.

8. The adjustable staircase according to claim 7, wherein the hand rail comprises at least two pieces which telescopically engage as the treads move from the lowered position to the one or more raised positions.

9. The adjustable staircase according to claim 1, further comprising a plurality of upright posts coupled to the frame, and each tread hanger being slidably engaged with a single one of the plurality of upright posts, for guiding the treads in a substantially vertical direction when the treads are moved from the fully lowered position to the one or more raised positions.

10. The adjustable staircase according to claim 1, wherein the adjustment bar is pivotally coupled to the frame at a height that allows the adjustment bar to be substantially horizontal when the treads are in a raised position suitable for training.

11. The adjustable staircase according to claim 1, wherein the rise between each tread is about 7.5 inches.

12. The adjustable staircase according to claim 9, wherein each upright post is equally spaced by a distance equivalent to the depth of each tread.

13. The adjustable staircase according to claim 1, comprising a lifting mechanism coupled to the adjustment bar, for moving the adjustment bar between a lowered and a raised position, wherein the movement of the adjustment bar from the lowered position to the raised position moves the treads from the fully lowered to the one or more raised position.

14. An adjustable staircase including a first step and at least one subsequent step, the adjustable staircase comprising:

at least two treads, each tread having a first and a second lateral end and the treads forming the first and subsequent steps of the staircase;

a frame for supporting the staircase on a supporting surface, the frame comprising:

a first newel post adjacent the first lateral end of the first step;

a second newel post adjacent the second lateral end of the first step;

a first end post adjacent the first lateral end of the last of the subsequent steps;

a second end post adjacent the second lateral end of the last of the subsequent steps;

a support bar connecting the first newel post to the first end post;

a second support bar connecting the second newel post to the second end post;

a plurality of upright posts connected to the first support bar in a spaced apart arrangement between the first newel post and the first end post;

a plurality of upright posts connected to the second support bar in a spaced apart arrangement between the second newel post and the second end post;

a first tread adjustment mechanism coupled to the frame and to the first lateral end of each step, the first tread adjustment mechanism comprising:

a first adjustment bar coupled to the first newel post for simultaneously moving the treads between a fully lowered position and one or more raised positions, wherein each raised position has a rise between each tread that is substantially equivalent; and a first tread hanger for each tread, each first tread hanger being suspended from the adjustment bar and each first tread hanger having a different length, each tread being coupled at the first lateral end to the respective first tread hanger; and a second tread adjustment mechanism coupled to the frame and to the second lateral end of each step, the second tread adjustment mechanism comprising:

a second adjustment bar coupled to the second newel post for moving the treads between the fully lowered position and the one or more raised positions in cooperation with the first adjustment bar; and a second tread hanger for each tread, each second tread hanger being suspended from the second adjustment bar and coupled to the second lateral end of one of the at least two treads, each second tread hanger having a length that is substantially the same as the length of the first tread hanger coupled to the first lateral end of the same tread, and wherein the tread of the first step engages the supporting surface when the tread of the first step is in the fully lowered position.

15. The adjustable staircase according to claim 14, wherein each first tread hanger is slidably engaged with a single one of the plurality of upright posts connected to the first support bar and the second tread hanger is slidably engaged with a single one of the plurality of the second upright posts connected to the second support bar.

16. The adjustable staircase according to claim 14, wherein the first adjustment bar is pivotally coupled to the first newel post and the second adjustment bar is coupled to the second newel post at a height that allows the adjustment bar to be substantially horizontal when the rise of the tread is about 7.5 inches.

17. The adjustable staircase according to claim 14, wherein each upright post is equally spaced by a distance equivalent to the depth of each tread.

* * * * *